United States Patent [19]

Prucha et al.

[11] Patent Number: 4,832,572

[45] Date of Patent: May 23, 1989

[54] FAN BLADE COVER

[76] Inventors: Doris A. Prucha, 6237 Mariana Dr., Parma Heights, Ohio 44130; Lois M. Sedlak, 16426 Pike Blvd., Brook Park, Ohio 44142

[21] Appl. No.: 946,408

[22] Filed: Dec. 24, 1986

[51] Int. Cl.[4] ..... F04D 29/70

[52] U.S. Cl. ..... 416/146 R; 416/62; 416/5

[58] Field of Search ..... 416/62, 5, 146 B, 224, 416/241 A, 146 R, 71, 247 R; 15/247

[56] References Cited

U.S. PATENT DOCUMENTS

| | | | |
|---|---|---|---|
| 76,875 | 4/1868 | Ainsworth | 416/71 |
| 925,031 | 6/1909 | Russel | 416/5 |
| 956,959 | 3/1910 | Greenfield | 416/71 |
| 1,150,436 | 8/1915 | Lang | 416/224 |
| 1,192,364 | 7/1916 | Zucker | 416/71 |
| 1,841,959 | 1/1932 | Kingsbury | 416/132 R |
| 2,033,345 | 3/1936 | Lee | 416/241 A X |
| 2,288,592 | 7/1942 | Mirhige | 15/247 |
| 2,949,092 | 8/1960 | Fortune | 416/62 |
| 2,962,999 | 12/1960 | Fortune | 416/62 |
| 2,990,889 | 7/1961 | Welch | 416/62 |
| 3,884,523 | 5/1975 | Allen | 296/136 |
| 3,913,164 | 10/1975 | Semenchuk | 15/247 |
| 3,977,451 | 8/1976 | Duba | 150/1.5 R |
| 4,126,169 | 11/1978 | Magnuson et al. | 150/54 B |
| 4,504,191 | 3/1985 | Brown | 416/146 R X |
| 4,530,178 | 7/1985 | Rauscher | 43/26 |
| 4,580,944 | 4/1986 | Miller | 416/224 X |
| 4,676,721 | 6/1987 | Hardee | 416/146 R |

FOREIGN PATENT DOCUMENTS

| | | | |
|---|---|---|---|
| 196337 | 10/1986 | European Pat. Off. | 416/62 |
| 73495 | 6/1977 | Japan | 416/241 A |
| 112391 | 9/1981 | Japan | 416/241 A |
| 424969 | 2/1935 | United Kingdom | 416/241 A |

*Primary Examiner*—Everette A. Powell, Jr.

*Attorney, Agent, or Firm*—Watts, Hoffmann, Fisher & Heinke

[57] ABSTRACT

A fan blade cover for use on fans having a plurality of fan blades, where one size cover fits many sizes and contours of fan blades. The cover includes a sleeve manufactured from a flexible material in a tubular configuration where one end of the sleeve is closed and an opposite end is open for mounting the cover on the fan blade. The open end of the sleeve includes a closure for closing off the open end to securely maintain the cover on the fan blade during fan operation.

2 Claims, 2 Drawing Sheets

FAN BLADE COVER

DESCRIPTION

1. Technical Field

This invention relates to a protective covering for use with fan blades, for example, on the fan blades of ceiling fans.

2. Background Art

Circulation fans of the type used in industrial and residential environments are typically manufactured having numerous fan blades of various shapes, sizes and materials. The fans are normally mounted on the ceilings of rooms for the purpose of recirculating room air. Manufacturers of the fan do not provide purchasers with protective coverings to surround the fan blades, and the fan blades are therefore open to the room and consequently readily visible to room occupants.

Because the fan blades are open to the room environment, substances such as dust, dirt and grease naturally tend to accumulate on the fan blades over a period of time, particularly on the surface of the blade located nearest the ceiling. This tendency is substantially accelerated when the fan is used in a commercial or industrial setting where the level of particulate matter in the air is increased. Fans positioned in residential kitchens are also subject to the more rapid accumulation of grease and dirt.

Placement of the fans on ceilings and in other elevated locations requires that special precautions be taken when cleaning the blades, especially the more inaccessible top surface of the blades.

In the past, cleaning the surfaces of the fan blades required an individual to climb and stand on a step ladder or stool during the entire process. As a result, cleaning was not only a difficult task, but also a dangerous one.

Use of fan blade covers on fan blades permits safe and easy cleaning, since the covers may be simply removed from the blades when necessary and either inexpensively replaced or easily cleaned. The covers also serve to enhance the overall appearance of the fan and fan blades, as the color and pattern of the material may be selected to coordinate with room decor. Additional decorative trim may also be either removably or permanently attached to the covers, to further enhance fan and fan blade appearance.

DISCLOSURE OF THE INVENTION

The present invention provides a protective cover for the fan blades of ceiling fans, where the cover is capable of fitting many sizes and contours of fan blades.

The cover comprises a tubular sleeve which is preferrably manufactured of an inexpensive material capable of conforming to the blade portion of the fan blades. The sleeve includes an open end portion having a closure for securing the sleeve on the blade portion during fan operation.

The open end portion of the sleeve receives the fan blade when the cover is slipped over the blade. When mounted on the blade portion, the open end is associated with a shaft end of the fan blade which is attached to a central portion of the fan. The sleeve also includes a closed end portion which is associated with an outer end of the blade portion which is spaced away from the central portion of the fan.

In a preferred embodiment, the closure used on the open end of the sleeve comprises an elasticized band.

The band expands to allow the cover to slip over an outer end of the fan blade to cover the blade portion, and contracts to surround the shaft end of the fan blade attached to the fan. The closure band is sufficiently strong to maintain the cover on the blade as the fan blades rotate during fan operation.

BEST MOST FOR CARRYING OUT THE INVENTION

Figure 1:
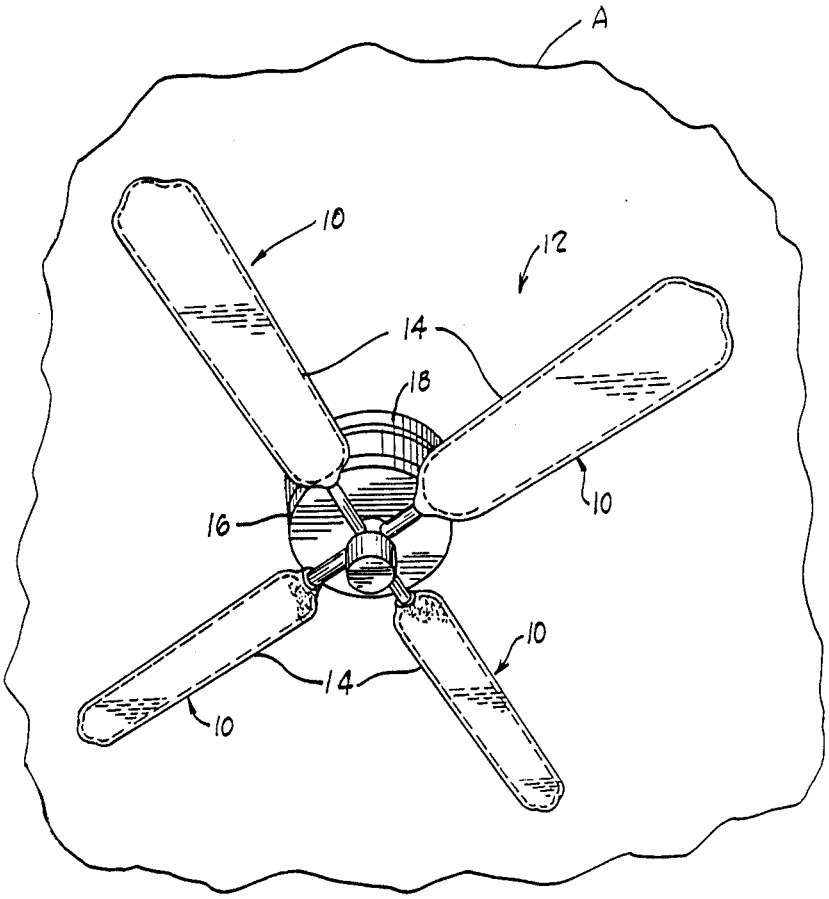
FIG. 1 is a perspective view of a ceiling fan with multiple fan blades having a protective covering thereon.
Figure 2:
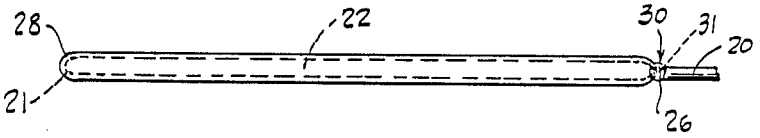
FIG. 2 is a side view of one of the fan blades shown in FIG. 1 with a cover embodying the present invention.

A fan blade cover 10 constructed in accordance with the invention is illustrated in FIG. 1 as applied to a circulation fan 12 of the type mounted on the ceiling A of a room. The fan fan blades 14 extend radially from a central rotating shaft 16 of the fan 12. The internal fan workings are hidden by a housing 18, from which the rotary shaft 16 extends.

As is the usual fashion, the fan blades 14 include a blade portion 22 and a shaft portion 20 for interconnection with the rotary shaft 16 of the ceiling fan 12. The fan blades 14 can be purchased having a variety of sizes and differing contours. As shown in FIGS. 2–5, the fan blade cover 10 comprises a tubular sleeve 24 which may be readily mounted on the fan blade 14. The sleeve 24 has an open end 26 for receiving the blade portion 22, and a closed end 28 which is associated with an end 21 of the fan blade which is spaced from the rotary fan shaft 16. The open end 26 of the fan blade cover 10 preferably includes structure for closing the open end and thereby enabling the cover 10 to surround the fan blade shaft 20 and prevent it from becoming dismounted as the fan blades 14 rotate during operation of the fan 12.

Figure 3:
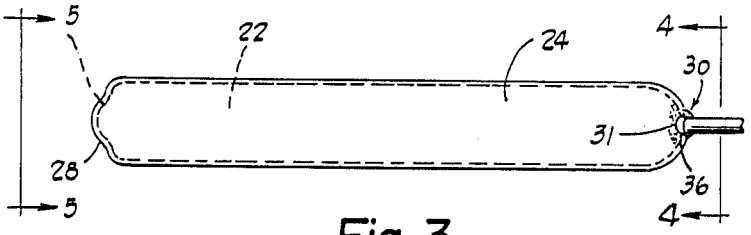
FIG. 3 is a bottom surface view of the fan blade and cover shown in FIG. 2.
Figure 4:
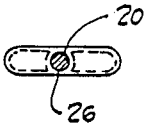
FIG. 4 is an end elevational view taken along the line 4—4 of FIG. 3.
Figure 5:
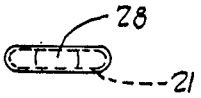
FIG. 5 is an end elevational view taken along the line 5—5 of FIG. 3.

As shown in FIGS. 3 and 4 a closure 30 used on the open end 26 consists of an internal elastic band 31. While the preferred closure 30 comprises an elastic type member, since it is desired that the closure surround the fan blade shaft 20, other methods of closing the open end 26 of the cover 10 are also available. Other methods include reclosable fasteners such as Velcro® strips, conventional two part snaps having male and female elements, a draw string to draw the open end 26 together with a cord which is confined within an inner hem or other material closures which would not interfere with operation of the fan blades 14 and central rotating fan shaft 16 during operation of the fan 12.

The cover 10 may be easily mounted on the fan blade 14, by simply expanding or opening the closure 30 on the open end 26 and physically sliding the sleeve 24 along the blade portion 22 until the sleeve 24 completely encases the blade portion 22 of the fan blade 14. When the sleeve is in the mounted position as shown, the elastic band closure 30 contracts to close the open end 26 by surrounding the fan blade shaft 20. When the fan blade cover 10 requires removal for cleaning, or it otherwise becomes necessary to remove the cover from the blade 14, the process is simply reversed. The ease with which the cover 10 can be mounted and removed reduces the risk previously involved with cleaning fan blades, since it is not necessary to stand on the chair or step ladder required to reach the blades 14 for such an excessive period of time.

The fan blade cover 10 is preferrably manufactured of an inexpensive, flexible plastic or other material which is capable of form fitting to a variety of fan blade sizes and contours. The material is preferably fire resistant as well as washable or disposable so that the covers may either be readily cleaned or thrown away upon removal from the fan blades. Since the fan blade covers enhance the overall appearance of the fan blades, the material may be of a variety of decorative colors and patterns, as well as capable of supporting additional decorations, such as ruffles or other appliques. The cover may also include a lining or be of the type which would allow the fan blade cover to be reversible.

While a preferred embodiment of this invention has been described in detail, it will be apparent that certain modifications or alterations can be made therein without departing from the spirit and scope of the invention set forth in the appended claims.

We claim:

1. A fan blade cover comprising:

a flexible tubular casing having an internal surface for form fitting engagement with a fan blade of an indoor ceiling fan when in a mounted position;

said casing having an opening in a first end of the casing for accessing said internal surface of said casing and associating with a shaft end of the fan blade interconnected with a shaft of the ceiling fan when said casing is in said mounted position on said fan blade, and a closed second end spaced from the opening and associated with a distal end of said fan blade; and an elastic band coupled to the casing and encircling the opening of said casing first end for allowing the opening to be enlarged to enable the tubular casing to be slipped over the fan blade and to contract for preventing movement of said casing and for maintaining said casing internal surface in form fitting engagement with said fan blade during operation of said ceiling fan;

said elastic band being attached to the casing at said opening of said casing first end, whereby said elastic band is movable past said distal end and said shaft end of said fan blade when said flexible casing is moved along said fan blade to said mounted position.

2. The cover of claim 1 wherein said casing is fabricated from a flexible material to fit multiple fan blade sizes and contours and includes an external surface for supporting decorations.

* * * * *